US005101805A

United States Patent [19]

Noh

[11] Patent Number: 5,101,805

[45] Date of Patent: Apr. 7, 1992

[54] GAS COOKER FOR OVEN AND GRILL COOKING

[75] Inventor: Chang Y. Noh, Seoul, Rep. of Korea

[73] Assignee: Samsung Electronics Co., Ltd., Suweon, Rep. of Korea

[21] Appl. No.: 688,461

[22] Filed: Apr. 22, 1991

[30] Foreign Application Priority Data

May 25, 1990 [KR] Rep. of Korea ..... 90-7632

[51] Int. Cl.[5] ..... A21B 1/00

[52] U.S. Cl. ..... 126/273 R; 126/41 R; 126/14

[58] Field of Search ..... 126/41 R, 39 K, 14, 126/273 R, 273 A, 20 R

[56] References Cited

U.S. PATENT DOCUMENTS 1,012,054 12/1911 Berry ..... 126/41 R 2,985,097 5/1961 Nevin et al. ..... 126/41

*Primary Examiner*—Carroll B. Dority

*Attorney, Agent, or Firm*—Burns, Doane, Swecker & Mathis

[57] ABSTRACT

A gas cooker includes a case defining a cooking chamber therein. A support for a food carrier is provided within the chamber, and a flame type of gas burner is situated at the bottom of the chamber. A heat control mechanism is situated between the burner and the food carrier, which can be adjusted to permit flames of the burner to reach the food carrier for grill-type cooking, or prevent the flames from reaching the food carrier for oven-type cooking.

7 Claims, 2 Drawing Sheets

FIG. 2
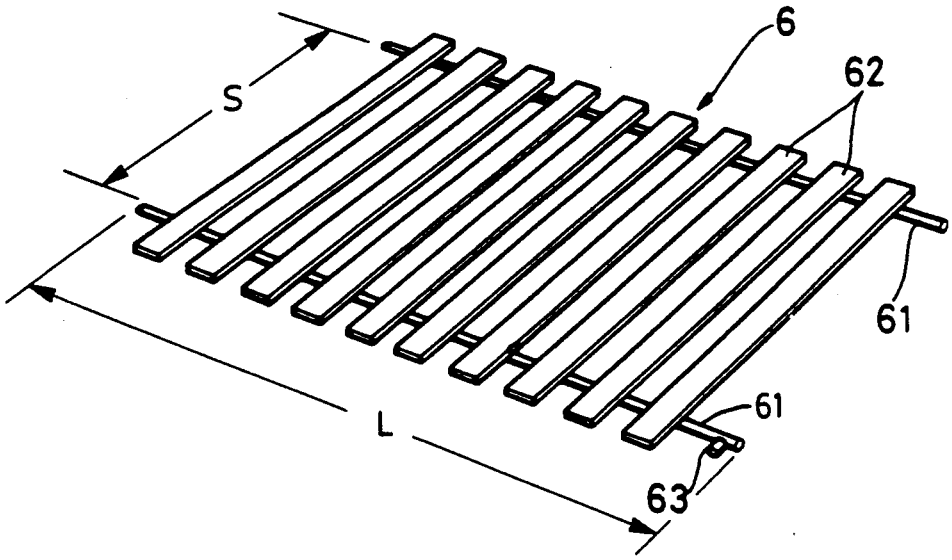
FIG. 3(a)
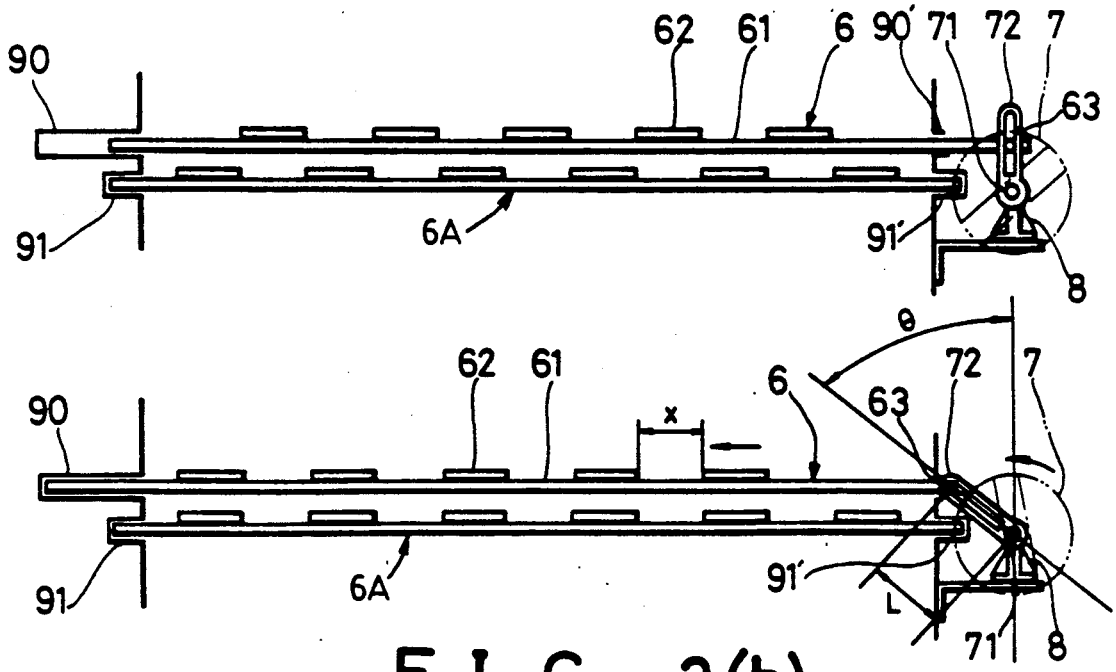
FIG. 3(b)

GAS COOKER FOR OVEN AND GRILL COOKING

BACKGROUND OF THE INVENTION

1. Field of the Invention

The invention relates to a gas cooker, particularly a gas cooker which serves both as an oven and a grill with a burner.

Generally, gas cookers have been of various types, for example, an oven range of a convection type, a grill range, and a gas range with both an oven and a grill.

In an oven range, a burner is mounted on the bottom of the cooking chamber. In a grill range, a burner is mounted on the top of the cooking chamber. The burner of the oven range is constructed to perform an oven function, and the burner of the grill range is constructed to perform a grill function.

Because a gas cooker with one burner functions as either an oven or a grill, but not both, it has a limited cooking function. Thus, it has the disadvantage that it must have a separate burner in order to fulfill both functions.

2. Description of the Prior Art

A known gas cooker with two burners has both an oven function and a grill function. The cooker includes a grill burner at the top of the cooking chamber and an oven burner at the bottom of the cooking chamber. A food container is put between the two burners. A heat reflecting plate which reflects the burning heat downwardly toward the food is mounted above the grill burner. A heat radiating plate installed at a predetermined position between the food container and the oven burner serves as a screen to keep the burning heat of the oven burner from being directly applied to the food container; rather the heat is applied indirectly to the container. Accordingly, a gas cooker with two burners performs either of two cooking functions chosen by the user who selectively operates either the grill burner or the oven burner.

A typical example of a gas burner with two burners is disclosed in Japanese Utility Publication SHO 61-1002. Two burners are installed, one at the bottom and one at the top of the cooking chamber. Mounted centrally at the top is a heat radiating plate which covers the top burner and is mounted at a predetermined distance from the top of the gas cooker. The heat radiating plate has a generally cup-shaped cross section. Many holes are drilled lengthwise and crosswise in the heat radiating plate. The heat radiating plate extends from the front side to the back side of the cooking chamber and its length is shorter than the length of the side wall. The heat radiating plate is inserted telescopingly into a heat control plate which is hollow and forms an internal space shaped correspondingly to the heat radiating plate. A multitude of holes are drilled in the heat control plate in the same pattern as the ones drilled in the heat radiating plate. The heat radiating plate is shorter than the hollow space of the heat control plate so as to be slidable lengthwise therein. Thus, when the heat radiating plate is slid between two extreme positions relative to the heat control plate, the holes in the heat radiating plate are either aligned or non-aligned with the holes in the heat control plate, i.e., the holes are either opened or closed. Thus, the heat applied to the food is controlled by the heat radiating plate and the heat control plate which are positioned between the food container and the top burner.

However, in that gas cooker, because two burners are installed in the cooking chamber, i.e., at the top and bottom thereof, and also because the heat radiating plate and the heat reflecting plate are mounted at the top of the cooking chamber, the gas cooker has the following disadvantages: the inside structure of the cooking chamber is complicated, the space of the cooking chamber is small, and the manufacturing cost is high because of the provision of two burners.

Accordingly, an object of the invention is to provide a gas burner possessing both an oven function and a grill function using only one burner.

Another object of the invention is to provide a gas cooker having a bottom burner which can directly or indirectly apply heat to foods with the use of a heat control mechanism.

SUMMARY OF THE INVENTION

This invention achieves those objectives while reducing the cost of manufacturing a gas cooker and keeping the structure of the gas cooker from being too complicated as in the case of using two burners.

In general, the present invention involves a gas cooker having an internal cooking chamber for selectively performing oven cooking and grill cooking of food. The gas cooker comprises a case forming the internal cooking chamber and including opposite side walls spaced apart in the direction of a width of the cooking chamber. The side walls include a support structure for supporting a food carrier. One of the side walls includes a cavity therein. A gas flame burner is situated adjacent a bottom of the chamber. A groove arrangement is formed in internal surfaces of the opposite side walls. A heat control mechanism is positioned between the burner and the support structure for controlling the transmission of flames from the burner to a food carrier. The heat control mechanism includes a plurality of heat control members slidably mounted in the groove arrangement and forming flame passages. The heat control members are relatively slidable for selectively obstructing the flame passages. An operating lever is pivotably mounted in the cavity and includes an elongated slot slidably receiving a drive element of one of the heat control members such that rotation of the operating lever produces the relative sliding movement between the heat control members. An actuating member which is accessible externally of the cavity, is provided for pivoting the operating lever in order to effect the relative sliding movement and thereby selectively admit flames to the food carrier for grill cooking, or shield the flames from the food carrier for oven cooking.

In a preferred embodiment, the gas cooker includes a cooking chamber formed in a case of rectangular shape. A food container is put on the supporting part which is formed at the approximate center of both side walls, so that the food is positioned in the approximate center of the cooking chamber. The burner is mounted on the bottom of the cooking chamber. The heat control members, more than two, are mounted between the food container and the burner.

The heat control member includes a pair of parallel frames which have a predetermined distance between each other. A number of panels are attached to the frames to extend perpendicularly thereto. The panels are spaced apart by a distance equal to a panel width. Thus, screening portions and open portions are alternately formed in the heat control member. A projecting drive element of one of the frames is coupled with the operation lever. Because the operation lever is fixed to an adjusting knob by a screw, it moves in response to rotation of the adjusting knob.

When the heat control member turns leftward or rightward in a predetermined angle, according to the rotation of the adjusting knob, the panels of the heat control members are either superimposed upon one another or staggered relative to each other. When the panels are staggered, they screen and absorb heat from the burner; thus, the panels emit the accumulated heat to the food container by convection and radiation. Accordingly, the gas cooker performs an oven function by evenly applying heat over the whole portion of the food. When the panels are superimposed one upon another, a flame is directly applied to the food container through the open portion whereby the gas cooker operates as a grill.

BRIEF DESCRIPTION OF THE DRAWINGS

The objects and advantages of the invention will become apparent from the following detailed description of preferred embodiments thereof in connection with the accompanying drawings in which like numerals designate like elements, and in which:

FIG. 2 is a perspective view of a heat control member of the gas cooker according to the invention;

FIG. 3*a* is a side elevational view illustrating a positional relationship of the heat control members for performing an oven cooking function according to the invention; and FIG. 3*b* is a view similar to FIG. 3*a* illustrating a positional relationship of the heat control members for performing a grill cooking function according to the invention.

DETAILED DESCRIPTION OF PREFERRED EMBODIMENTS OF THE INVENTION

Figure 1:
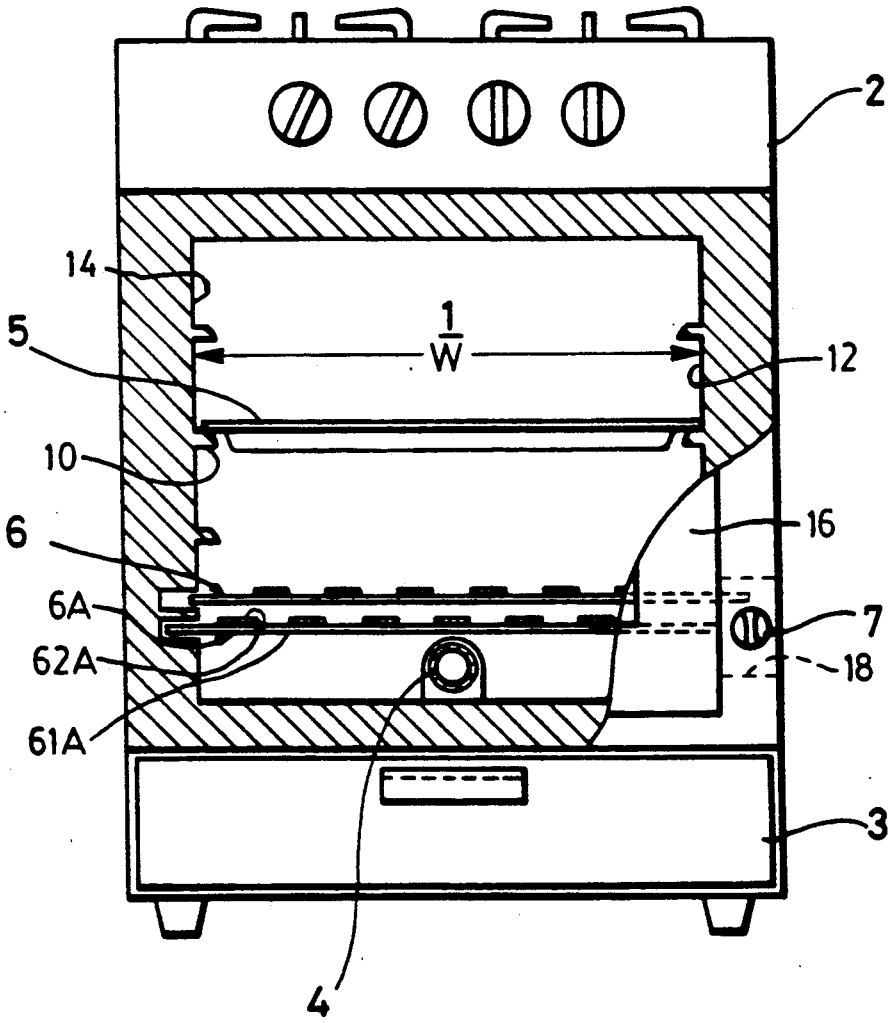
FIG. 1 is a cross-sectional view through a gas cooker according to the invention.

FIG. 1 is a cross-sectional view showing the structure of a gas cooker according to the present invention. The gas cooker includes a cooking chamber 1, a gas range 2 at the upper side, and a table ware drier 3 at the lower side. A conventional burner 4 is mounted in a known fashion at the bottom of the cooking chamber 1. Supporting members 10 are projected in the center of the inner side wall. A food container 5 slides into and from the cooking chamber 1 upon the supporting members, the supporting members being spaced at predetermined heights from the burner 4.

Upper and lower heat control members 6, 6A are provided and supported within grooves 90, 90', 91, 91' formed in the inner side walls 12, 14 of the cooker. The upper heat control member 6 is supported by grooves 90 and 90', and the lower heat control member 6A is supported by grooves 91 and 91'.

In FIGS. 2 and 3, the heat control members are depicted in greater detail. The upper heat control member 6 comprises a pair of parallel frames 61, 61. The spacing S between the frames 61, 61 is less than the length (i.e., front-to-rear depth) of the cooking chamber. The length L of the frames is longer than the transverse width W of the cooking chamber 1 extending from left to right. A plurality of rectangular panels 62 arranged perpendicular to the frames have equal spaces between them. The panels 62, which are affixed to the frames 61, 61 are shorter than the front-to-rear depth of the cooking chamber 1, which depth is measured perpendicular to the plane of the paper in FIG. 1. A projecting pin member 63 projects perpendicularly from one end of one of the frames 61. The projecting member 63 has a diameter less than the diameter of the frame and a short length.

The lower heat control member 6A is shaped generally similarly to that of the upper heat control member 6, except that the frames 61A of the latter are shorter than those of the former, and an extra panel 62A may be provided. Also, no projecting member 63 is provided on the lower heat control member 6A.

The spacing x between the panels 62 is equal to the width of each panel 62. The same is true for the panels 62A. By shifting the upper heat control member 6 transversely relative to the lower heat control member 6A, the flame of the burner 4 can be alternately screened from, or applied to, the food container 5 as will be explained hereinafter.

The grooves 90, 90', 91, 91' are horizontally formed in the inner side walls 12, 14 and have a front-to-rear depth longer than the spacing S between frames 61, 61 and 61A, 61A. The heat control members 6, 6A are inserted into the respective grooves 90, 90', 91, 91'. When at least two grooves are formed in each side wall, the two heat control members are arranged parallel and adjacent to one another, while being supported by both inner side walls 12, 14.

Upper grooves 90 and 90' extend transversely for a greater distance than grooves 91 and 91' for ensuring that the upper heat control member 6 can move leftward and rightward in a horizontal direction relative to the lower heat control member 6A.

FIGS. 3*a* and 3*b* are views illustrating the cooperating operation of an operation lever 72 and an adjusting knob 7, the adjusting knob 7 being illustrated in phantom lines. The projecting member 63 of the upper heat control member 6 is inserted into an elliptical slot of the operation lever 72. When the operation lever 72 is rotated by the adjusting knob 7, the upper heat control member 6 is horizontally shifted leftward or rightward by the operation lever 72.

All of the walls of the case, except for the front door 16, have a thickness suitable for receiving insulting and heat shield materials (for example, glass wool between its inner and outer sides). The inner side wall 14 has an internal cavity 18 adjacent its lower right corner. The cavity 18 communicates with the groove 90'. The right end of frame 61 of the upper heat control member 6 extends into the cavity 18 from the groove 90'. The projecting member 63 projects forwardly from the associated frame 61 and is perpendicular to that frame 61 in the same plane therewith.

In the cavity 18 there is disposed a pedestal 8 which has a base fixed to the inner side wall 14 by a screw. A shaft 71 extends into the pedestal 8. The operation lever 72 is pivoted on the shaft 71. The projecting member 63 is interlocked within the elliptically shaped slot of the operation lever 72. When the operation lever rotates, the projecting member 63 is displaced leftward or rightward within the elliptical slot. The adjusting knob 7 is fixed to the operation lever 72 so that it may produce rotation of the operation lever 72 within a predetermined angle $\theta$. The upper heat control member 6 is slidably mounted in the grooves 90, 90', and the lower heat control member 6A is stationary in the grooves 91, 91'.

The operation lever's rotating angle $\theta$ is determined as follows, so that the distance which the upper member is slid is equal to the width x of each panel 62. The effective length L of the operation lever 72 is determined in order to obtain the following relationship $L \cdot \sin \theta = x$. Therefore, when the adjusting knob 7 has been rotated counterclockwise at the maximum angle $\theta$, the upper and lower panels 62, 62A are superposed one upon another so as to be in an open position (see FIG. 3*a*). When the knob 7 has been rotated clockwise to a rest position (see FIG. 3*b*), the panels 62, 62A are mutually staggered, so as to be in a screening position.

IN OPERATION, the food container 5 is placed on two supporting members 10, and then the burner 4 is fired up. At this time, either the oven function or the grill function is selected by the user's operation of the adjusting knob 7. The adjusting knob 7 is moved together with the operation lever 72 because of being fixed to it. Since the projecting member 63 is linked with the elliptical slot of the operation lever 72, the member 63 is horizontally pushed or pulled according to the rotation of the operation lever 72.

As shown in FIG. 3*a*, when the adjusting knob 7 is rotated counterclockwise to the maximum, the panels 62, 62A of two heat control members 6, 6A are mutually staggered, so that the spaces between the lower panels 62A are covered by the upper panels 62 and vice versa. Thus, the flames which are generated at burner 4 are screened by the heat control members 6, 6, so that they do not touch the bottom of food container 5.

Therefore, the flame generated at the burner 4 heats the heat control members 6, 6A. The heated heat control members 6, 6A radiate heat by radiation and convection. Because the radiated heat is evenly and constantly applied to the food, the cooker performs an oven function. Since the panels 62, 62A are to be directly touched by the flame from burner 4, they are made of steel and plated with aluminum so they will not be distorted by heat and will exhibit good heat conductivity. Preferably, the panels have a thickness of approximately 0.8 mm.

When the gas cooker performs a grill function, the arrangement of the heat control members 6, 6A is as shown in FIG. 3*b*. At this time, the panels 62, 62A are superimposed one upon the other, so that the heat control members 6, 6A form spaces. Accordingly, the flame generated at burner 4 is directly applied to food container 5 through the spaces, and the food is cooked by direct heat.

It will be appreciated that the gas cooker according to the present invention can be applied to conventional gas cooker cases. That is, it is not necessary to effect a comprehensive redesign of the case. Since the cooker requires only one burner to perform both oven and grill cooking, the cost of an extra burner can be avoided, and the cooker can be more easily and economically manufactured.

Numerous variations of the afore-described structure are possible. For example, the member 6A could be shifted instead of the member 6. Alternatively, both members 6, 6A could be shifted simultaneously in opposite directions by a suitable reconfiguring of the operating lever.

Also, the heat control member 6 could be shifted by a mechanism other than the knob 7, e.g., by means of a motor. For instance, the motor could comprise a motor having a rotary output shaft. The operation lever 72 would be driven by the motor which would rotate the shaft 71. An electric switch (for example, push button) would replace the adjusting knob 7. A gear or pulley would be mounted on the rotating center of operation lever 72, and a spaced reduction member (for example, gear or belt) would be coupled to the motor and the shaft 71, whereby the heat control member 6 would be shifted leftward and rightward by actuation of the motor. The left and right movement would be selected by changing the polarity of the motor or speed reduction member.

Another type of motor which could be used is a solenoid which could be used to rotate the operating lever. Alternatively, the operating lever could be dispensed with. Rather, the solenoid would be mounted in the cavity of the side wall, and magnetic material would be attached to the right end of frame 61. Electric wires of the solenoid would be connected to an electric switch. The heat control member 6 would be shifted leftward and rightward by reversing the polarity of the solenoid Also, in order to absorb shock occurring when the ends of frame 61 make contact with the side wall, shock absorbing materials (for example, a spring) could be attached to the ends of frames 61.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims.

What is claimed is:

1. A gas cooker having an internal cooking chamber for selectively performing oven cooking and grill cooking of food, comprising:

a case forming said internal cooking chamber and including opposite side walls spaced apart in the direction of a width of said cooking chamber, said side walls including support means for supporting a food carrier, one of said side walls including a cavity therein, a gas flame burner situated adjacent a bottom of said cooking chamber, groove means formed in mutually facing surfaces of said opposite side walls, heat control means positioned between said burner and said support means for controlling the transmission of flames from said burner to a food carrier, including:

a plurality of heat control members slidably mounted in said groove means and forming flame passage means, said heat control members being relatively slidable for selectively obstructing said flame passage means, an operating lever pivotably mounted in said cavity and connected to one of said heat control members by a pin-and-slot connection so that rotation of said operating lever produces said relative sliding between said heat control members movement, and actuating means accessible externally of said cavity for pivoting said operating lever in order to effect said relative sliding movement to selectively admit flames to the food carrier for grill cooking, or shield the flames from the food carrier for oven cooking.

2. A gas cooker according to claim 1, wherein said pin-and-slot connection comprises an elongated slot formed in said operating lever and a pin projecting from said one heat control member and slidably received in said slot.

3. A gas cooker according to claim 1, wherein said actuating means comprises a manually rotatable knob mounted on an outside surface of said case and connected to said operating lever by a shaft.

4. A gas cooker according to claim 1, wherein said groove means includes horizontally aligned grooves formed in respective ones of said side walls, said one of said heat control means having its opposite ends mounted in respective ones of said grooves and being slidable horizontally within said grooves.

5. A gas cooker according to claim 1, wherein each of said heat control members includes two parallel frames each being longer than said width of said cooking chamber, a plurality of panels mounted on said frames and extending perpendicular to said width of said cooking chamber, said panels being spaced apart to define equal spaces therebetween, said heat control members being arranged one above the other so that in response to said relative sliding movement, said spaces of said heat control members can be placed in superimposed relationship for defining said flame passage means or in staggered relationship to obstruct said flame passage means.

6. A gas cooker according to claim 2, wherein said pin is disposed on an end of one of said frames thereof, said elongated slot being oriented in a vertical plane, said lever being pivotable about a horizontal axis, and said pin extending horizontally.

7. A gas cooker according to claim 1, wherein said operating lever is pivotable through an angle of predetermined magnitude such that the extent of said relative sliding movement equals each of said spaces.

* * * * *